US007082989B2

(12) United States Patent
Kobayashi et al.

(10) Patent No.: US 7,082,989 B2
(45) Date of Patent: Aug. 1, 2006

(54) HEAT EXCHANGER

(75) Inventors: Masahiro Kobayashi, Ota (JP); Hideaki Mukaida, Oizumi-Machi (JP); Hiroshi Mukaiyama, Oizumi-Machi (JP); Norio Sawada, Oizumi-Machi (JP); Masafumi Ueda, Oizumi-Machi (JP); Shigeya Ishigaki, Ora-Machi (JP); Koji Sato, Oizumi-Machi (JP)

(73) Assignee: SANYO Electric Co., Ltd., Gunma-Ken (JP)

( * ) Notice: Subject to any disclaimer, the term of this patent is extended or adjusted under 35 U.S.C. 154(b) by 0 days.

(21) Appl. No.: 11/218,455

(22) Filed: Sep. 2, 2005

(65) Prior Publication Data

US 2005/0284617 A1 Dec. 29, 2005

Related U.S. Application Data

(63) Continuation-in-part of application No. 09/611,562, filed on Jul. 7, 2000, now abandoned.

(30) Foreign Application Priority Data

Feb. 29, 2000 (JP) ..... 2000-053617

(51) Int. Cl.
*F28F 1/20* (2006.01)
*F28D 1/04* (2006.01)

(52) U.S. Cl. ..... 165/151; 165/181

(58) Field of Classification Search ..... 165/151, 165/152, 135, 181–182
See application file for complete search history.

(56) References Cited

U.S. PATENT DOCUMENTS

| | | | | |
|---|---|---|---|---|
| 4,907,646 | A * | 3/1990 | Aoyagi et al. | 165/151 |
| 5,553,663 | A * | 9/1996 | Yu | 165/151 |
| 5,706,885 | A * | 1/1998 | Kim | 165/151 |
| 5,755,281 | A * | 5/1998 | Kang et al. | 165/151 |
| 5,975,199 | A * | 11/1999 | Park et al. | 165/151 |
| 6,026,893 | A * | 2/2000 | Jung et al. | 165/151 |
| 6,142,220 | A * | 11/2000 | Motegi et al. | 165/135 |
| 6,227,289 | B1 * | 5/2001 | Yokoyama et al. | 165/151 |

* cited by examiner

*Primary Examiner*—Tho Duong
(74) *Attorney, Agent, or Firm*—J.C. Patents

(57) ABSTRACT

A heat exchanger is provided in which high heat transfer efficiency has been attained by optimizing the slit array and setting an optimum range for the width of a slit and the spacing between slits. Slits 51 and 52 formed in front of the heat transfer coil 4 and slits 55 and 56 formed behind the heat transfer coil are arranged so as to provide a mutually different length among adjoining partitioned slits in the vertical direction, as well as a mutually different length between directly opposite partitioned slits in the horizontal direction. As a result, the position at which the slit is partitioned is staggered.

2 Claims, 4 Drawing Sheets

( A )

( B )

HEAT EXCHANGER

CROSS-REFERENCE TO RELATED APPLICATION

This application is a continuation-in-part of application Ser. No. 09/611,562 filed on Jul. 7, 2000, now abandoned, which claims the priority benefit of Japanese application serial No. 2000-053617, filed Feb. 29, 2000.

BACKGROUND OF THE INVENTION

1. Field of the Invention

The present invention is related to a heat exchanger used in air conditioners and the like.

2. Description of the Prior Art

In an air conditioner comprising an indoor unit and outdoor unit, a heat exchanger 1 of a type, for example, as shown in FIG. 4(A) is mounted in the indoor unit, and a heat exchanger 2 of a type as shown in FIG. 4(B) is mounted in the outdoor unit. Each heat exchanger is comprised of a heat transfer fin unit in which heat transfer coils 4, through which a cooling medium flows, penetrate through a row of multiple heat transfer fins set at a specified fin pitch.

In a typical heat exchanger, two heat transfer fin units configured in this manner are closely adjoined in parallel. For this, it was desirable to develop a heat transfer fin with a smaller number of slits to reduce draft resistance. After examining a variety of configurations, it was discovered that heat transfer efficiency could be maximized with a relatively small number of slits at a certain slit width.

An example of the subject of the present invention is shown in FIG. 3, whereby four relatively wide slits are formed on the surface of a heat transfer fin. In this figure, 31, 32 are two heat transfer fin units which comprise a heat exchanger, 4 is a heat transfer coil, and 61, 62, 63, 64 are four slits formed, in order from the left, on the surface of a heat transfer fin. Each of these slits is pushed out to form a slope. In the diagram, numbering of the same slits formed for each of the other heat transfer coils of heat transfer fin units 31 and 32 is omitted.

Slit 61 is positioned relative to the air flow in front of heat transfer coil 4, while slit 64 is positioned behind the heat transfer coil. Slits 62, 63 are formed between a heat transfer coil 4 and another heat transfer coil 4. This slit configuration is the same for each of the other heat transfer coils of heat transfer fin units 31, 32.

As air flow onto the heat transfer fins of a heat exchanger of this type is created with the intake of air in the direction of the arrow, there will be little air resistance in the center where there are few slots. Consequently, the wind speed will be faster in the center than above or below that area, and the flow of air at the center will also be distributed unevenly. As such, the slits cannot be utilized effectively since air does not make uniform contact with the slits, and the heat exchanging activity of the heat exchanger does not function efficiently.

SUMMARY OF THE INVENTION

Accordingly, the objective of the present invention is to provide a heat exchanger in which the slit array, slit width, and slit spacing are set at an optimum range such that air sucked into the heat exchanger and flowing through the slits is distributed uniformly and makes sufficient contact with all slits to achieve highly efficient heat transfer.

A heat exchanger characterized as follows is provided to achieve the aforementioned objective. As claimed in the present invention, a heat exchanger in which heat transfer coils penetrate through a row of multiple plate-shaped heat transfer fins set at a specified fin pitch and in which air is supplied orthogonally to the heat transfer coils, is configured so as to satisfy the correlation expressed by the following numerical formula:

$$Ws \geqq (1-0.1(6-N)) \times W_F/(2N+1)$$

wherein, Ws=width of a slit, $W_F$=width of a heat transfer fin, and N=the number of slits per slit array.

As claimed in the present invention, a heat exchanger in which heat transfer coils penetrate through a row of multiple plate-shaped heat transfer fins set at a specified fin pitch and in which air is supplied orthogonally to the heat transfer coils, is configured such that the width of each slit formed orthogonal to the air flow on each heat transfer fin is set within a range of 0.17–0.29 times the diameter of the heat transfer coils.

As claimed in the present invention, a heat exchanger in which heat transfer coils penetrate through a row of multiple plate-shaped heat transfer fins set at a specified fin pitch and in which air is supplied orthogonally to the heat transfer coils, is configured such that the spacing between slits formed on the heat transfer fins is set within a range of 0.18–0.5 times the diameter of the heat transfer coils.

As claimed in the present invention, a heat exchanger in which heat transfer coils penetrate through a row of multiple plate-shaped heat transfer fins set at a specified fin pitch and in which air is supplied orthogonally to the heat transfer coils, is configured such that the width of each slit formed on each heat transfer fin is set within a range of 0.17–0.29 times the diameter of the heat transfer coils, and the spacing between slits formed on the heat transfer fins is set within a range of 0.18–0.5 times the diameter of the heat transfer coils.

By setting the slit width and the slit spacing at an optimum range in this manner, the heat exchange amount (efficiency) of the slits can be increased, thereby improving the heat transfer efficiency of the heat exchanger.

As claimed in the present invention, a heat exchanger in which heat transfer coils penetrate through a row of multiple plate-shaped heat transfer fins set at a specified fin pitch and in which air is supplied orthogonally to the heat transfer coils, is configured such that within the plural number of slit arrays formed on a heat transfer fin, within a given array each slit formed on either edge of a heat transfer fin is partitioned into slits of different length, and the position at which the slit is so partitioned on each of the two sides of the heat transfer fin is staggered.

As claimed in the present invention, a heat exchanger in which heat transfer coils penetrate through a row of multiple plate-shaped heat transfer fin set at a specified fin pitch and in which air is supplied orthogonally to the heat transfer coils, is configured such that of the plural number of slits formed on a heat transfer fin, except for those slits formed between two heat transfer coils, adjoining slits in the vertical direction are of mutually different length, and the position at which the slits are partitioned is staggered.

In this manner, air resistance is not governed by the number of slits and is virtually uniform, and the wind speed at the center varies only slightly from the wind speed above or below the center. There is also no uneven distribution of air flow at the center. Consequently, the air contacts all slits uniformly for an effective utilization of the slits to increase the heat transfer efficiency of the heat exchanger.

DETAILED DESCRIPTION OF THE PREFERRED EMBODIMENTS

From simulation trials, it was discovered that there is a correlation between the slit array and an optimum range of slit width, and slit spacing. The present invention was completed based on that correlation. The slit array is explained with reference to an enlarged diagram of a portion of the heat transfer fin of a heat exchanger in FIG. 1.

Figure 1:
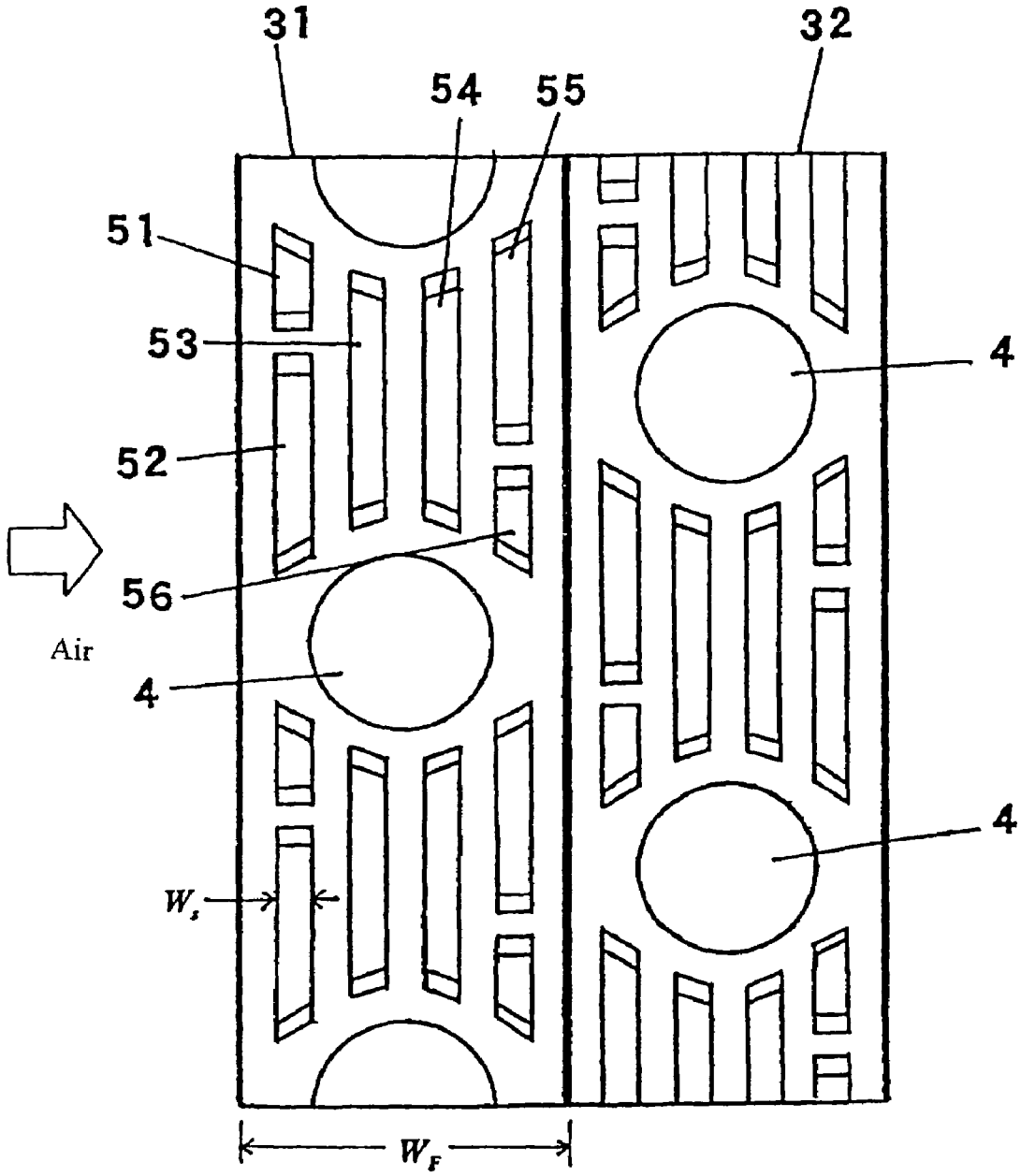
FIG. 1 shows the slit arrangement of the present invention.

As shown in FIG. 1, a heat transfer fin is configured from heat transfer coils 4, and slits 51, 52, 53, 54, 55, 56 cut and formed on the surface of a heat transfer fin, wherein slits 51, 52 are located in front of the heat transfer coil, and slits 55, 56 are located behind the heat transfer coil, and slits 52, 55 are longer than slits 51, 56. These slits are pushed out to form a square angle. A number of slits, such as the slits 51, 52, 53, 54, 55, 56, form a slit array. In other words, one slit array can also be referred to be the slits between adjacent two coils 4 in one heat transfer fin unit.

Partitioned slits 51 and 52 formed in front of the heat transfer coil 4 and slits 55 and 56 formed behind the heat transfer coil are arranged so there is a mutually different length among adjoining partitioned slits in the vertical direction, as well as a mutually different length between directly opposite partitioned slits in the horizontal direction. As a result, the position at which the slits are partitioned is staggered. However, slits 53 and 54 formed side by side between heat transfer coils 4 are of the same length.

As air flow onto the heat transfer fin with the slits arranged as shown in FIG. 1 is created with the intake of air in the direction of the arrow, resistance to the air flow is not a function of the number of slits and is virtually uniform, and the wind speed at the center is not that much different from the wind speed in the upper or lower regions.

Figure 2:
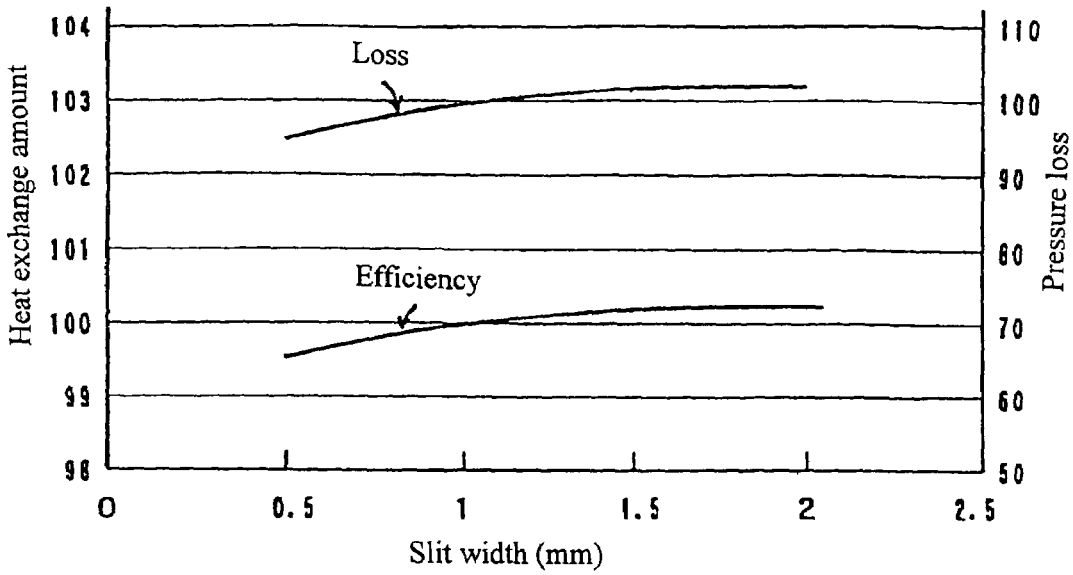
FIG. 2 shows the heat exchange amount and pressure loss characteristics.
Figure 2:
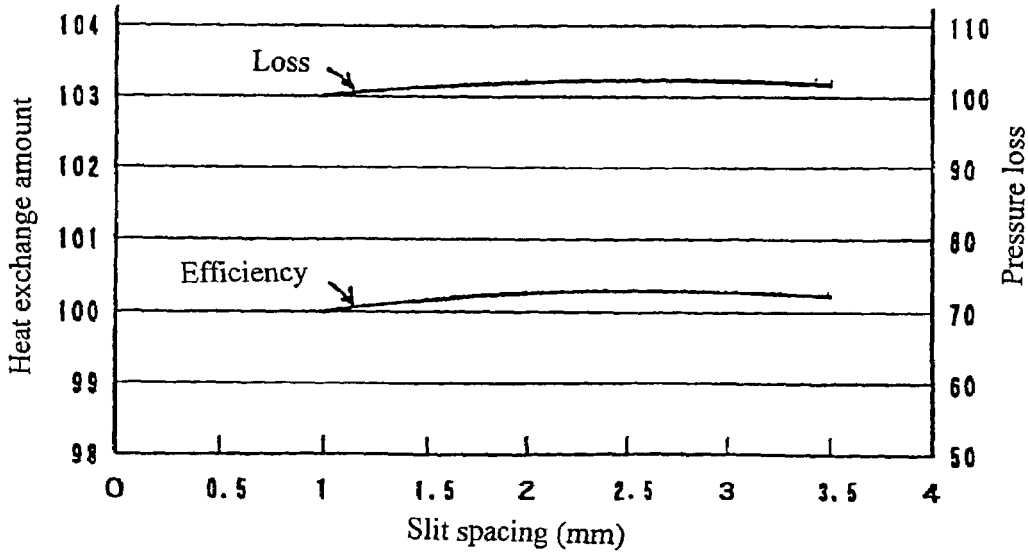
Figure 3:
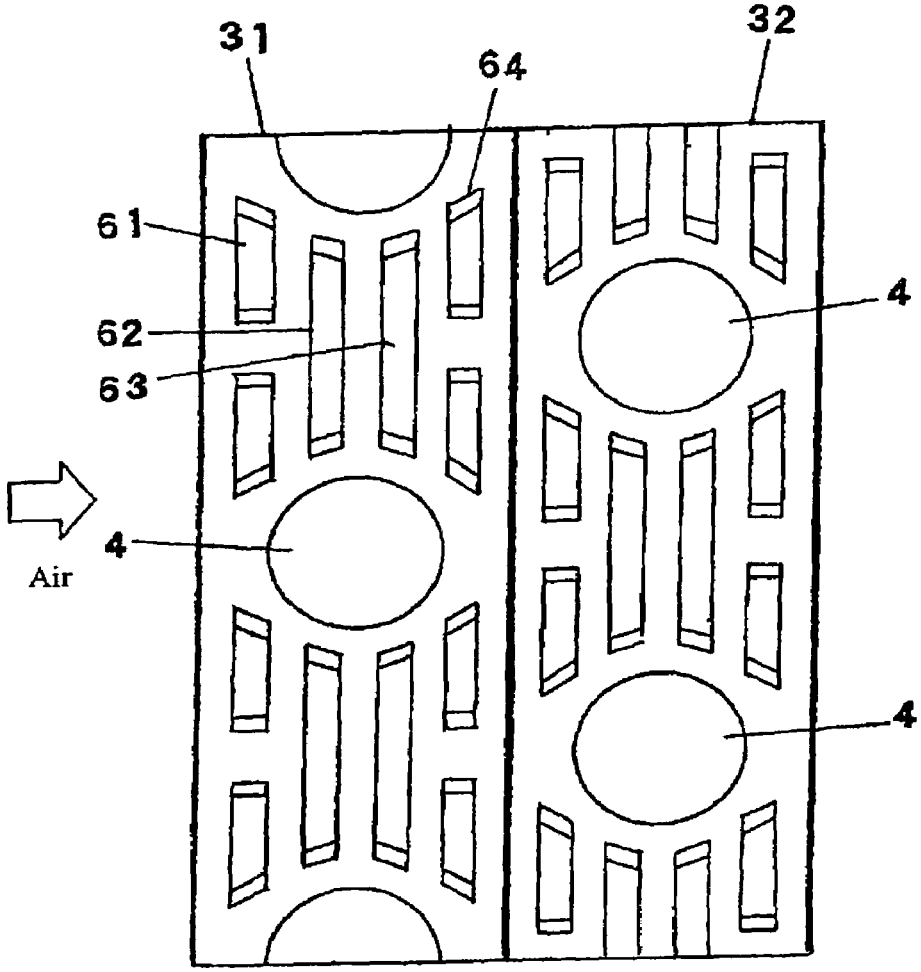
FIG. 3 (PRIOR ART)
FIG. 3 shows the conventional slit arrangement.
Figure 4A:
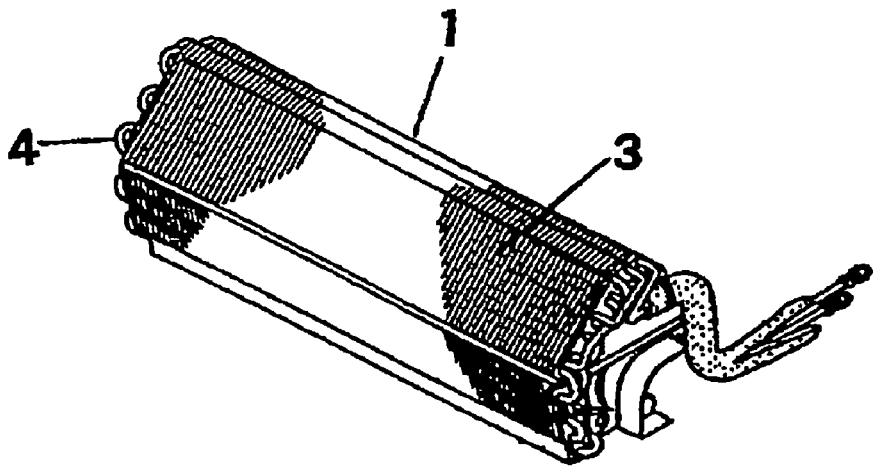
FIG. 4A (PRIOR ART)
FIG. 4 shows the indoor unit and outdoor unit of a heat exchanger.
Figure 4B:
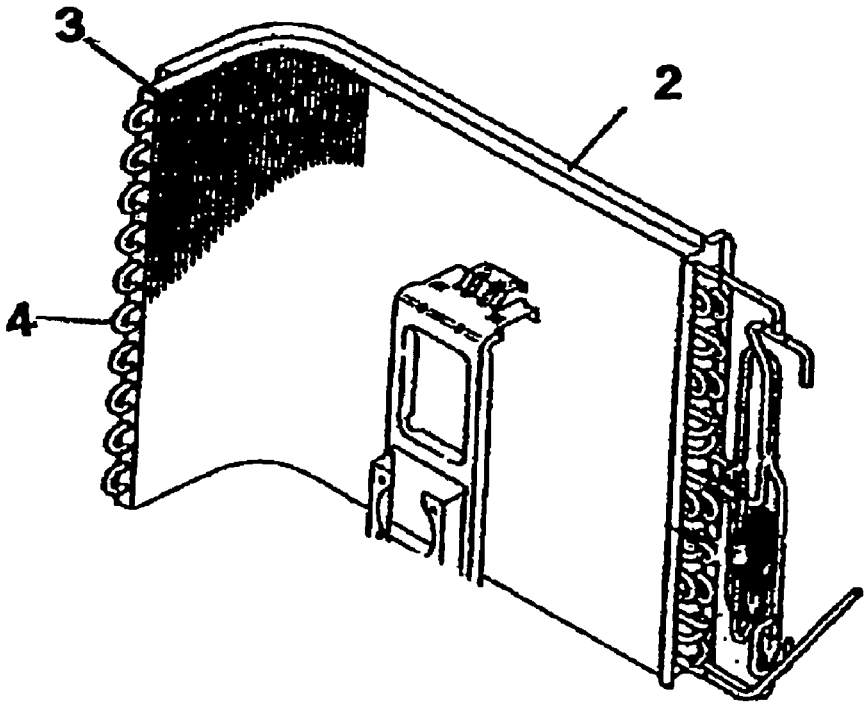
FIG. 4B (PRIOR ART)

There is also no uneven distribution of air flow at the center. Consequently, the air makes equal contact with all slits for an effective utilization of the slits, thereby increasing the heat transfer efficiency of the heat exchanger. Simulation trials were also conducted with respect to slit width and slit spacing, and it was discovered that there is a correlation between an optimum range of slit width and slit spacing as shown by the heat exchange amount and pressure drop characteristics in FIG. 2. Measurements were obtained using a 7 mm diameter heat transfer coil, and the correlation between slit width versus heat exchange amount (efficiency) and slit width versus pressure drop (loss) are shown in FIG. 2(A). The Correlation between slit spacing versus heat exchange amount (efficiency) and slit spacing versus pressure drop (loss) are shown in FIG. 2(B).

The results indicate that the optimum relationship between slit width and slit spacing is one which satisfies the following numerical formula for a heat transfer fin configuration of 6 slits or less per width of one fin array:

$$Ws \geqq (1-0.1\ (6-N)) \times W_F/(2N \times 1)$$

wherein, Ws=width of a slit, $W_F$=width of each of heat transfer fin unit 31, 32, (namely the width of one fin array) and N=the number of slits per slit array. For the foregoing example, N=6 in this example.

Namely, the optimum slit width Ws for high efficiency of heat transfer ranges from 1.2–2.0 mm, and the optimum slit spacing for high efficiency ranges from 2.0–3.5 mm. Converting these values with the diameter of the heat transfer coil as a reference, the optimum slit width for high heat transfer efficiency ranges from 1.2/7 (approximately 0.17) to 2.0/7 (approximately 0.29) times the diameter of the heat transfer coil.

Similarly, the optimum slit spacing for high heat transfer efficiency ranges from 1.3/7 (approximately 0.18) to 3.5/7 (approximately 0.5) times the diameter of the heat transfer coil. Moreover, it was discovered from measurements taken with heat transfer coils of different diameter that the optimum ranges were generally the same as the aforementioned values.

As a result of various simulation experiments as described above, it was discovered that the heat transfer efficiency of a heat exchanger could be increased by using the heat transfer fins of the present invention, in which the position at which slits are partitioned is staggered, and the slit width and/or slit spacing is set within a specified range relative to the diameter of the heat transfer coils.

In the heat exchanger of the present invention as described above, the slits formed on a heat transfer fin are formed such that with the exception of the slits formed between heat transfer coils which are of equal length, the other slits are formed such that adjoining partitioned slits in the vertical direction are of mutually different length, and the position at which the slits are partitioned is staggered. Then by setting the slit width and/or the slit spacing formed on a heat transfer fin within a specified range relative to the diameter of the heat transfer coil, the intake air will be in contact with all slits uniformly. This effective utilization of the slits will increase the heat transfer efficiency of the heat exchanger.

What is claimed is:

1. A structure of heat transfer fin mounted within a heat exchanger that includes a plurality of heat transfer tubes penetrating through the heat transfer fin, wherein air is supplied orthogonally to the heat transfer tubes, and the heat transfer fin is partitioned in at least one fin unit in which slit arrays of slits are arranged in a row, the heat transfer fin being characterized in that the arrangement of the slit arrays of slits satisfies the following formula:

$$Ws \geqq [1-0.1(6-N)] \times W_f/(2N+1),$$

wherein Ws=width of one slit, $W_f$=width of a fin unit, and N=the number of slits per slit array.

2. The heat exchanger of claim 1, wherein each heat transfer tube has a diameter of about 7 mm.

* * * * *